United States Patent [19]

Baumhardt

[11] Patent Number: 4,549,507

[45] Date of Patent: Oct. 29, 1985

[54] TWO CYCLE LOOP SCAVENGED ENGINE WITH IMPROVED TRANSFER PASSAGE FLOW

[75] Inventor: Robert J. Baumhardt, Eden, Wis.

[73] Assignee: Brunswick Corp., Skokie, Ill.

[21] Appl. No.: 652,299

[22] Filed: Sep. 19, 1984

[51] Int. Cl.[4] ..... F02B 33/04

[52] U.S. Cl. ..... 123/59 B; 123/65 P; 123/73 PP

[58] Field of Search ..... 123/59 B, 73 PP, 73 R, 123/73 A, 65 P, 65 PD, 74 R, 74 B, 193 C

[56] References Cited

U.S. PATENT DOCUMENTS

| | | | |
|---|---|---|---|
| 2,190,011 | 2/1940 | Boxan | 123/65 A |
| 2,729,204 | 1/1956 | Meyer | 123/59 B |
| 3,494,335 | 2/1970 | Meier | 123/73 R |
| 4,066,050 | 1/1978 | Ford-Dunn | 123/73 PP |
| 4,306,522 | 12/1981 | Fotsch | 123/73 PP |
| 4,328,770 | 5/1982 | Hale | 123/59 B |
| 4,474,145 | 10/1984 | Boyesen | 123/73 PP |

FOREIGN PATENT DOCUMENTS

| | | | |
|---|---|---|---|
| 1435958 | 5/1976 | United Kingdom | 123/73 PP |

*Primary Examiner*—Craig R. Feinberg
*Assistant Examiner*—David A. Okonsky
*Attorney, Agent, or Firm*—Andrus, Sceales, Starke & Sawall

[57] ABSTRACT

Horsepower and fuel economy improvements, and a reduction in horsepower variation, are realized in a two cycle loop scavenged internal combustion engine by enhancing combustion chamber (10) intake directional flow (28) by directing flow along the outermost portions (54) of the transfer passages (12), and blocking flow along shorter paths (56) adjacent the cylinder (6) which otherwise short-circuit the outermost flow and adversely affect directional flow into the combustion chamber from the intake ports (16), to substantially eliminate intake flow directed toward the exhaust port (26) from the intake port otherwise caused by the short-circuiting. The intake port flow in the combustion chamber is afforded in a direction determined by the non-short-circuited path in the transfer passage, and the direction-altering flow in the combustion chamber from the intake port otherwise due to the short-circuit path is substantially eliminated.

7 Claims, 10 Drawing Figures

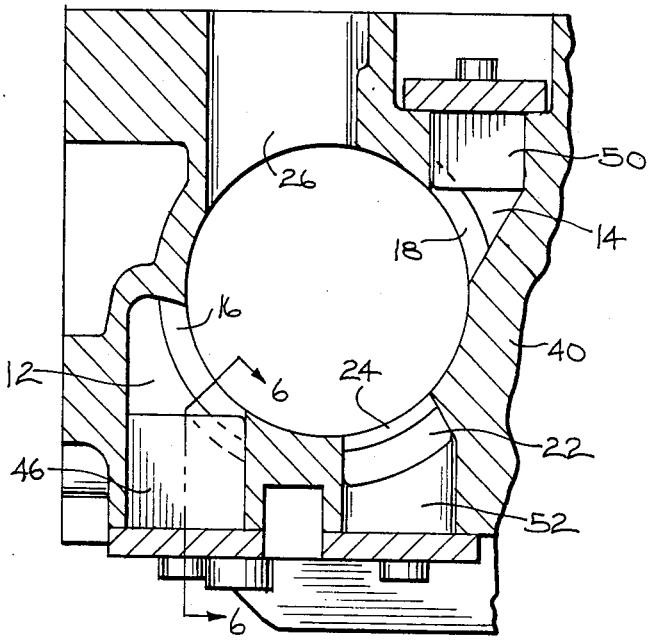
FIG. 4
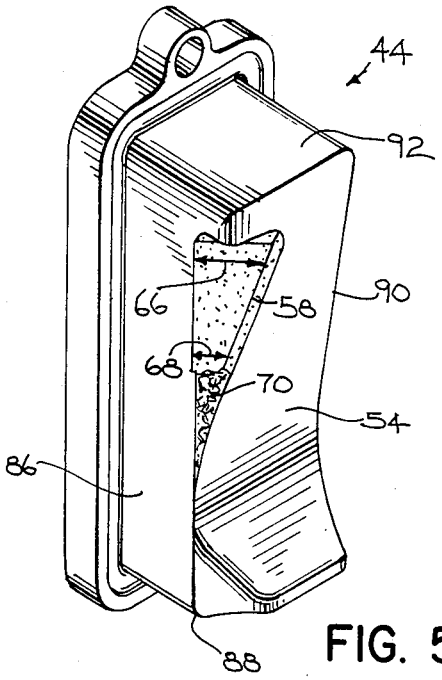
FIG. 5
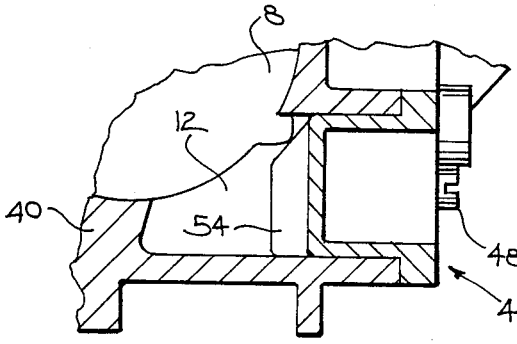
FIG. 7
FIG. 6
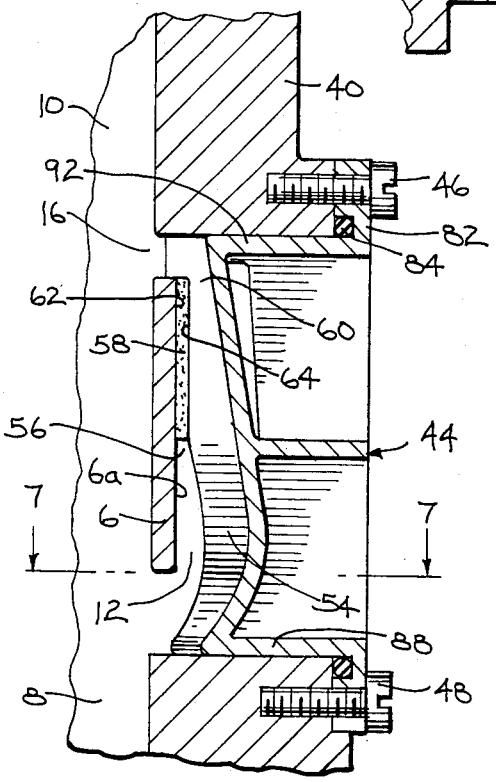
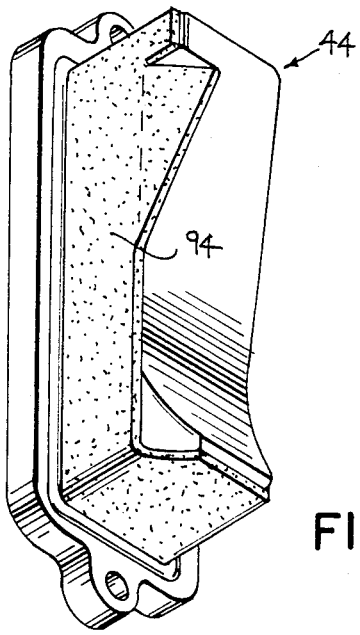
FIG. 8

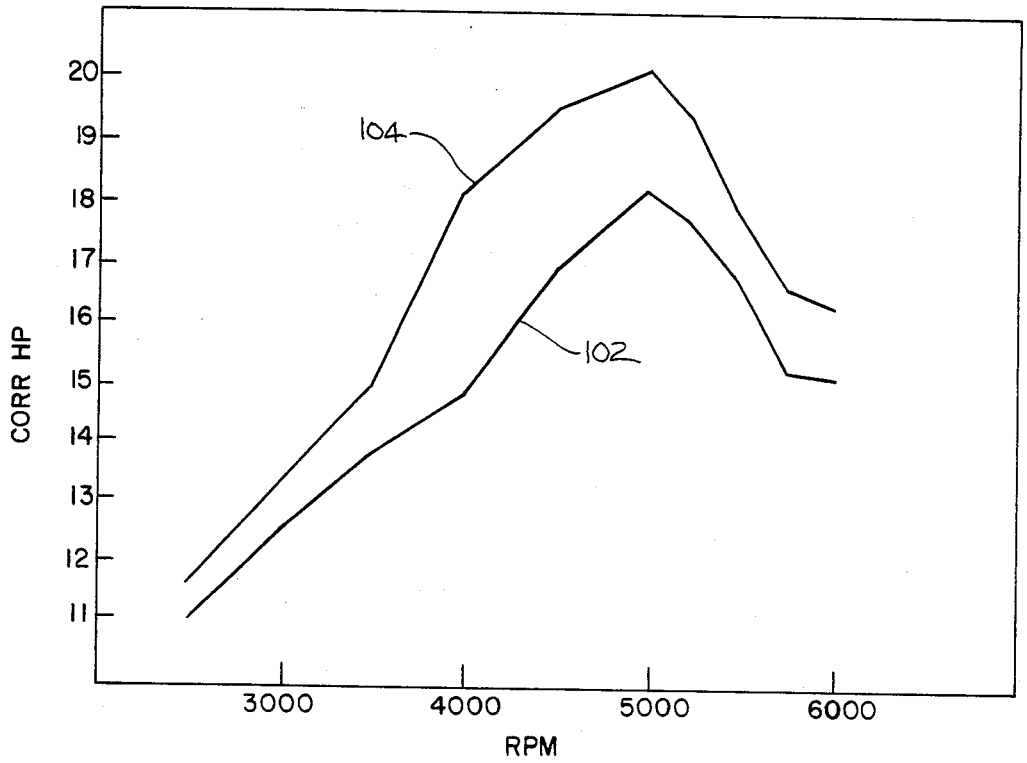
FIG. 9
FIG. 10
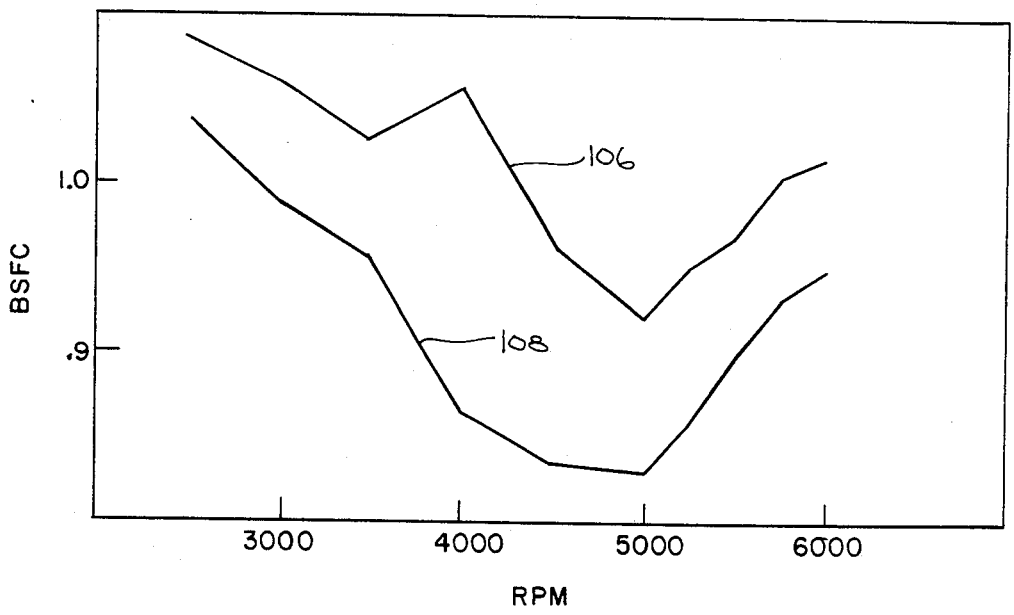

TWO CYCLE LOOP SCAVENGED ENGINE WITH IMPROVED TRANSFER PASSAGE FLOW

BACKGROUND AND SUMMARY

The present invention relates to a two cycle loop scavenged internal combustion engine having a piston reciprocal in a cylinder between a crankcase and a combustion chamber in a die cast cylinder block. The crankcase is typically carbureted or otherwise supplied with fuel, and fuel-air transfer passages extend between the crankcase and intake ports in the combustion chamber for supplying the fuel-air charge thereto.

In a loop scavenged engine, the direction of flow from the intake ports in the combustion chamber is critical. In contrast, the aiming of the intake charge in a cross flow type engine is not so critical because the piston in the cross flow engine has a deflection baffle in the combustion chamber.

In a loop scavenged engine, there typically are a pair of intake ports in the combustion chamber generally laterally opposed, with an exhaust port therebetween on one side, and a boost port therebetween on the other side. The transfer passages deliver the fuel-air flow to the intake ports, and the intake flow should optimally be directed from the intake ports towards each other to a common point generally distally opposite the exhaust port and proximate the boost port for circulation up and around the top of the combustion chamber to purge spent combustion products to the exhaust port.

The transfer passages extend within the cylinder block along the exterior wall of the cylinder and have respective die-tooling-receiving openings generally opposite the exterior cylinder wall to permit die casting of the block. Respective die cast port runner covers are inserted in the noted cylinder block openings. The port runner covers have a given configuration to shape the respective transfer passages.

The shapes of the transfer passages may be changed by changing the inner configuration of the port runner covers, and this is a typical design approach in attempting to improve performance. The main objectives in shaping the transfer passage are to provide the desired directivity and to provide smooth uniform undisturbed air flow. Thus, sharp corners or anything else that creates turbulence is avoided. Different area ratios are tried as the transfer passage gets smaller at its end toward the combustion chamber intake port so that the flow velocity is highest thereat. Various angles of intake flow are also experimented with to obtain optimum directivity.

It was during development efforts in shaping transfer passages, as above noted, that the present invention arose. During work with a Mercury 18 horsepower engine, various transfer passage shapes were tried, and the optimum shapes yielded corrected brake horsepower outputs of 18 horsepower. However, the corrected brake horsepower output would vary from engine to engine. For example, for the same shape transfer passage, the corrected brake horsepower output could vary by as much as 1 horsepower. The variation was seemingly unexplainable.

Numerous attempts with differently shaped transfer passages were made in order to try to both improve performance and narrow the horsepower variation window spread, without success.

Instead, it has been found that, while the shape of the transfer passage is important, there is another previously unrecognized factor causing the noted horsepower variation window. It is now recognized that the source of the variation problem is a short-circuiting path in the transfer passage which adversely affects directivity of flow into the combustion chamber from the intake port. This short-circuit path is along the exterior wall of the cylinder and is shorter than the flow path along the outermost portions of the transfer passage farthest away from the cylinder. The short-circuit flow directed a component of the intake flow toward the exhaust port and thus also detracted from performance.

Both horsepower and fuel economy have been improved, and the horsepower variation spread window has been narrowed, by enhancing combustion chamber intake directional flow control by directing flow along the outermost portions of the transfer passages, and blocking flow along shorter paths adjacent the cylinder which otherwise short-circuit the outermost flow and adversely affect directional flow into the combustion chamber from the intake ports, to substantially eliminate intake flow directed toward the exhaust port from the intake ports otherwise caused by the noted short-circuiting. In the noted Mercury 18 horsepower engine, both corrected brake horsepower and brake specific fuel economy have been increased by 10%, and the horsepower variation window has been substantially reduced to an almost negligible spread.

BRIEF DESCRIPTION OF THE DRAWINGS

FIG. 4 is a sectional view taken along line 4—4 of FIG. 2.

FIG. 5 is an enlarged perspective view from the other side of the port runner cover of FIG. 2.

FIG. 6 is a sectional view taken along line 6—6 of FIG. 4.

FIG. 7 is a sectional view taken along line 7—7 of FIG. 6.

FIG. 8 is a view like FIG. 5 but showing an alternate embodiment.

FIG. 9 is a graph showing corrected brake horsepower versus rpm.

FIG. 10 is a graph showing brake specific fuel consumption versus rpm.

DETAILED DESCRIPTION

Figure 1:
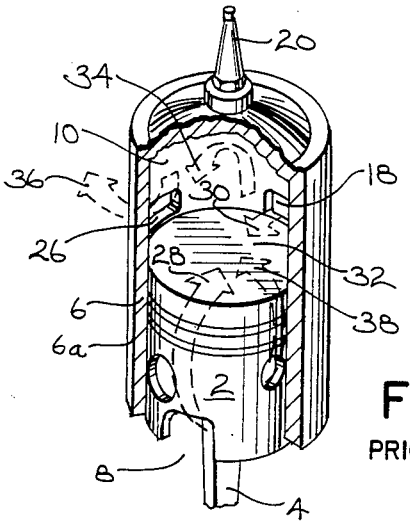
FIG. 1 PRIOR ART
FIG. 1 is a schematic perspective illustration of loop scavenging in a combustion chamber.

FIG. 1 illustrates loop scavenging in a two cycle internal combustion engine, for example as shown in Hale U.S. Pat. No. 4,328,770 incorporated herein by reference. Piston 2 with connecting rod 4 is reciprocal in a cylinder 6 between a crankcase 8 and a combustion chamber 10. The crankcase is typically carbureted or otherwise supplied with fuel. A pair of fuel-air transfer passages 12 and 14, FIG. 4, deliver fuel-air mixture from the crankcase to a respective pair of intake ports 16 and 18 in the combustion chamber. During the up-stroke of piston 2, the fuel-air mixture is compressed in combustion chamber 10, and upon ignition of spark plug 20 combustion of the mixture drives piston 2 downwardly to provide the power stroke. This downward movement forces fuel-air mixture to flow from the crankcase into the transfer passages 12 and 14 and hence into the combustion chamber through intake ports 16 and 18 for repetition of the cycle. A boost passage 22 and port 24 may be provided to aid circulation and purging. Intake ports 16 and 18 are generally laterally opposed, with exhaust port 26 therebetween on one side, and boost port 24 therebetween on the other side. Intake flow paths 28 and 30 from the intake ports are optimally directed towards each other and away from exhaust port 26 to a common point 32 generally opposite the exhaust port for circulation 34 up, over and around within combustion chamber 10 to purge spent combustion products to exhaust port 26 as shown at exhaust flow 36. Boost flow 38 from the boost port may aid such circulation, all as is well known.

Figure 2:
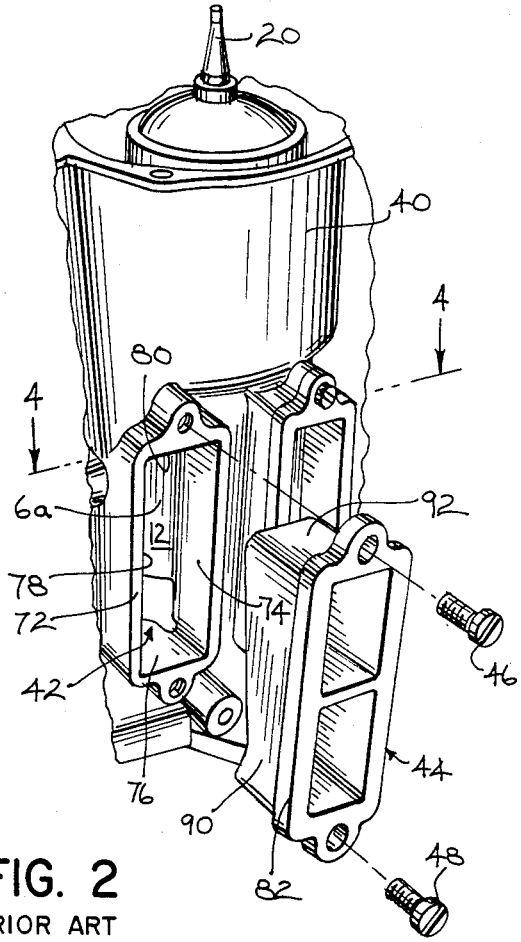
FIG. 2 PRIOR ART
FIG. 2 is a perspective illustration of a portion of a die cast cylinder block, and also shows a die cast port runner cover removed therefrom.

FIG. 2 shows a portion of a die cast cylinder block 40, for which an exemplary full view may be seen in said U.S. Pat. No. 4,328,770. FIG. 2 uses like reference numerals as FIG. 1 to facilitate clarity. The transfer passages such as 12 extend within the block along the exterior wall *6a* of cylinder 6 and have respective die-receiving openings such as 42 generally opposite the exterior cylinder wall *6a* to permit die casting of the block by receiving the die tooling therein. The transfer passages such as 12 are partially formed by the cylinder block casting and are completed by die cast port runner covers such as 44 bolted to block 40, for example by bolts 46 and 48. The port runner covers such as 44 have a given configuration to shape the respective transfer passages such as 12. Said U.S. Pat. No. 4,328,770 is cited for further reference regarding die cast cylinder blocks and port runner covers.

FIG. 5 shows the other side of the port runner cover 44 of FIG. 2, illustrating a configuration which shapes transfer passage 12 when cover 44 is inserted in opening 42. FIG. 4 shows port runner covers 50 and 52 in the other transfer passage 14 and the boost passage 22, respectively. FIG. 6 shows a side view of shaped transfer passage 12 with port runner cover 44 inserted. Combustion chamber intake directional flow 28, FIG. 1, from intake port 16, FIGS. 4 and 6, is enhanced by directing flow along the outermost portions 54, FIGS. 5 and 6, of transfer passage 12 farthest away from cylinder 6, and blocking flow along shorter paths 56 adjacent the cylinder along exterior cylinder wall *6a*, which shorter paths otherwise short-circuit the outermost flow at 54 and adversely affect directional flow 28 into combustion chamber 10 from intake port 16.

The blocking of path 56 has been found to substantially eliminate intake flow directed toward exhaust port 26 otherwise caused by the noted short-circuiting. Fuel-resistant material 58 may be a foam rubber such as epichlorohydrin marketed by the Rubatex Corporation, Stock No. R-472-E. The material 58 is disposed along exterior cylinder wall *6a* to block flow therealong and prevent short-circuiting of the outermost flow at 54 and in turn substantially eliminate components of intake flow toward exhaust port 26. The configuration of port runner cover 44 shapes transfer passage 12 and directs flow from crankcase 8 in a path outwardly away from cylinder wall *6a* and curving and funneling passage 12 to a smaller lateral area 60 toward intake port 16 to increase flow velocity thereat, as is typical in prior designs. Material 58 is a strip of sufficient thickness to bear contiguously between facing portions 62 and 64 respectively of the exterior cylinder wall *6a* and port runner cover 44. As seen in FIGS. 5 and 6, material strip 58 is trapped between and engages portions 62 and 64 of the cylinder wall and port runner cover toward the intake port end of the transfer passage, and blocks flow contiguously along exterior cylinder wall *6a* to in turn afford intake flow through intake port 16 in the combustion chamber in a direction determined by the non-short-circuited path at 54 in transfer passage 12, and substantially eliminate direction-altering flow in the combustion chamber from intake port 16 otherwise due to the noted short-circuit path.

Material strip 58 has a length extending in the flow direction through transfer passage 12. Strip 58 has a tapered width which increases toward the intake port end of the transfer passage. As seen in FIG. 5, strip 58 has a greater width at section 66 which is adjacent intake port 16. The strip narrows in width, as at section 68, toward the middle of the transfer passage. Strip 58 may be attached to port runner cover 44 by gluing or any other suitable means before insertion into the transfer passage at opening 42 in the cylinder block. Strip 58 is partially cutaway in FIG. 5, showing that the surface 70 of the port runner cover may be cross-hatched, knurled or otherwise roughened to better retain and hold strip 58. Other retention means may of course be used.

Figure 3:
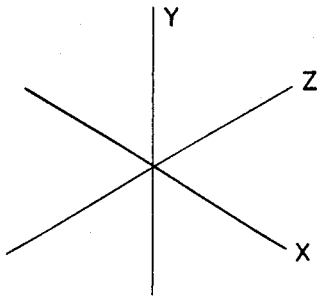
FIG. 3 PRIOR ART
FIG. 3 is a cut-away view of a portion of FIG. 2 to better illustrate a transfer passage and its orientation.
Figure 3:
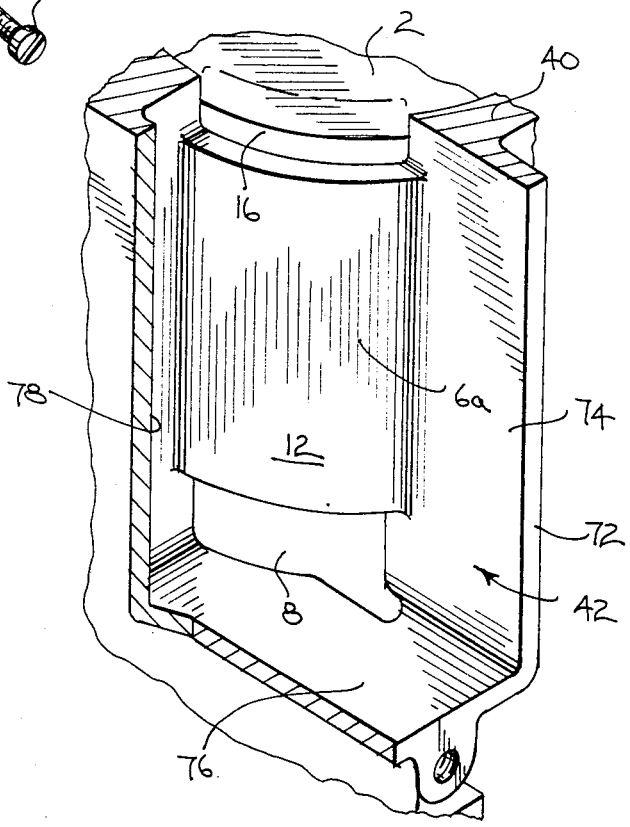
FIG. 3 PRIOR ART

Opening 42 in the cylinder block, FIGS. 2 and 3, has a rectangular outer surface 72 lying in a y–z plane as shown with the orientation axes. The reciprocal movement of piston 2 is in the y-direction. Opening 42 in the cylinder block extends inwardly in the x-direction into the block. The x, y and z directional axes are normal to each other. Opening 42 is formed by four sidewalls 74, 76, 78 and 80 extending in the x-direction inwardly from rectangular outer surface 72. Sidewall 74 extends inwardly to exterior cylinder wall *6a* which then extends in an arc further inwardly in the x-direction and also in the z-direction.

Port runner cover 44 has an outer portion 82 at rectangular outer surface 72 of opening 42 and may be sealed thereagainst by a rectangular O-ring type gasket 84, FIG. 6. Port runner cover 44 has four sidewalls 86, 88, 90 and 92, FIGS. 2 and 5, extending into opening 42 in the x-direction adjacent the four sidewalls 74, 76, 78 and 80, respectively, of opening 42 in the cylinder block. Port runner cover 44 has an inner surface 54 lying generally in the y–z plane at the innermost extent of the port runner cover sidewalls 86, 88, 90 and 92. Port runner cover 44 has an oblique surface 70 extending between the noted innermost surface 54 and sidewall 86 adjacent the sidewall 74 of cylinder block opening 42.

In another embodiment, the fuel-resistant material strip 94, FIG. 8, also extends along port runner cover sidewall 86 adjacent and contiguously against sidewall 74 of cylinder block opening 42. This has been found to desirably prevent puddling of fuel. Fuel may collect or puddle in the gap between sidewalls 86 and 74, which may cause smoking or the like due to release of an undesirably concentrated mixture. Strip 94 is thus preferred to prevent to puddling.

Strip 94 is also preferred for a better shape and fit around the port runner cover. Strip 94 is an integral one-piece member extending along surface 70 and sidewall 86, and also along at least a portion of sidewall 88 which meets sidewall 86 at the crankcase end of the transfer passage.

FIG. 9 is a graph plotting corrected brake horsepower versus revolutions per minute, rpm, for a Mercury 18 horsepower engine. Curve 102 is for an engine without the improvement of the present invention. Curve 104 shows the data for the same engine but with the improvement of the present invention wherein combustion chamber intake directional flow control is enhanced by directing flow along the outermost portions of the transfer passages farthest away from the cylinder and blocking flow along shorter paths adjacent the cylinder which otherwise short-circuit the outermost flow and adversely affect directional flow from the respective intake ports into the combustion chamber, to substantially eliminate intake flow directed toward the exhaust port from the intake ports otherwise caused by short-circuiting. Plotted data curve 104 shows a 10% increase in horsepower over curve 102, demonstrating the horsepower improvement when the intake port flow in the combustion chamber is afforded in a direction determined by the non-short-circuited path in the transfer passage and the elimination of the direction-altering flow in the combustion chamber from the intake port otherwise due to the short-circuit path.

FIG. 10 is a graph plotting brake specific fuel consumption versus rpm for the noted Mercury 18 horsepower engine. Curve 106 is the plotted data for the engine without the improvement of the present invention. Curve 108 is the plotted data for the same engine but with the improvement of the present invention. A 10% improvement in fuel economy is realized.

The invention thus provides significant performance improvements, in both horsepower and fuel economy. It has further been found that the horsepower variation spread window from engine to engine is substantially diminished to an almost negligible value with the improvement of the present invention.

It is recognized that various alternatives and modifications are possible within the scope of the appended claims.

I claim:

1. In a two cycle loop scavenged internal combustion engine having a piston reciprocal in a cylinder between a crankcase and a combustion chamber in a die cast cylinder block having a transfer passage between said crankcase and an intake port in said combustion chamber, said transfer passage extending within said cylinder block along the exterior wall of said cylinder and having a die-receiving opening generally opposite to said exterior cylinder wall to permit die casting of said cylinder block, and having a die cast port runner cover received in said opening, said port runner cover having a given configuration to shape said transfer passage and direct flow from said crankcase in a path outwardly away from said cylinder wall and curving and funneling said passage to a smaller lateral area toward said intake port to increase flow velocity thereat, the improvement comprising: means in said transfer passage blocking flow contiguously along said exterior cylinder wall in said transfer passage which would otherwise short-circuit the flow through the remainder of said transfer passage in said path curved away from said cylinder wall and funneled to said smaller area at said intake port, whereby to afford intake port flow in said combustion chamber in a direction determined by the non-short-circuited path in said transfer passage, and substantially eliminate direction-altering flow in said combustion chamber from said intake port otherwise due to said short-circuit path, wherein said blocking means in said transfer passage comprises fuel-resistant material trapped between and engaging portions of said exterior cylinder wall and said port runner cover toward the intake port end of said transfer passage.

2. The invention according to claim 1 wherein said fuel-resistant material comprises a strip of sufficient thickness to bear contiguously between facing said portions of said exterior cylinder wall and port runner cover, said strip having a length extending in the flow direction through said transfer passage and having a tapered width which increases toward the intake port end of said transfer passage.

3. A two cycle loop scavenged internal combustion engine comprising:

a piston reciprocal in a cylinder between a crankcase and a combustion chamber in a die cast cylinder block having a transfer passage between said crankcase and an intake port in said combustion chamber;

said transfer passage extending within said cylinder block along the exterior wall of said cylinder and having a die-receiving opening generally opposite said exterior cylinder wall to permit die casting of said cylinder block;

a die cast port runner cover received in said opening in said cylinder block and having a given configuration shaping said transfer passage and directing flow from said crankcase in a path curved outwardly away from said exterior cylinder wall and curving and funneling said transfer passage to a smaller lateral area toward said intake port to increase flow velocity thereat;

means in said transfer passage blocking flow contiguously along said exterior cylinder wall in said transfer passage which would otherwise short-circuit the flow through the remainder of said transfer passage in said path curved away from said exterior cylinder wall and funneled to said smaller area at said intake port, whereby to afford intake port flow in said combustion chamber in a direction determined by the non-short-circuited path in said transfer passage, and substantially eliminate direction-altering flow in said combustion chamber from said intake port otherwise due to said short-circuit path;

said blocking means in said transfer passage comprising fuel-resistant material trapped between and engaging portions of said exterior cylinder wall and said port runner cover proximate the intake port end of said transfer passage;

said opening in said cylinder block having an outer surface on said block lying in a y–z plane, the reciprocal movement of said piston being in the y-direction, said opening in said cylinder block extending inwardly in an x-direction into said block, where x, y and z directional axes are normal to each other, said opening being formed by sidewalls extending in the x-direction from said outer surface, one of said sidewalls extending inwardly to said exterior cylinder wall which then extends in an arc further inwardly in the x-direction and also in the z-direction;

said port runner cover has an outer portion at said outer surface of said opening in said cylinder block and has sidewalls extending into said opening in said x-direction adjacent said sidewalls of said opening in said cylinder block, and has an inner surface lying generally in a y–z plane at the innermost extent of said port runner cover sidewalls and has an oblique surface extending between said innermost surface and the port runner cover sidewall adjacent said one sidewall of said opening in said cylinder block, said fuel-resistant strip being disposed along said oblique surface.

4. The invention according to claim 3 wherein said oblique surface has retention means for holding said strip.

5. The invention according to claim 3 wheren said fuel-resistant material comprises a strip of sufficient thickness to bear contiguously between facing said portions of said exterior cylinder wall and said port runner cover, said strip having a length extending in the flow direction through said transfer passage and having a tapered width which increases toward the intake port end of said transfer passage.

6. The invention according to claim 3 wherein said fuel-resistant strip also extends along said last mentioned port runner cover sidewall adjacent said one sidewall of said opening in said cylinder block to prevent puddling of fuel.

7. The invention according to claim 6 wherein said fuel-resistant strip comprises an integral one-piece member and further extends along at least a portion of the port runner sidewall which meets said last mentioned port runner sidewall at the crankcase end of said transfer passage.

* * * * *